US011313379B2

(12) United States Patent
Iwakiri et al.

(10) Patent No.: US 11,313,379 B2
(45) Date of Patent: Apr. 26, 2022

(54) CENTRIFUGAL COMPRESSOR AND TURBOCHARGER INCLUDING THE SAME

(71) Applicant: MITSUBISHI HEAVY INDUSTRIES ENGINE & TURBOCHARGER, LTD., Sagamihara (JP)

(72) Inventors: Kenichiro Iwakiri, Tokyo (JP); Yoshihiro Hayashi, Tokyo (JP); Seiichi Ibaraki, Tokyo (JP)

(73) Assignee: MITSUBISHI HEAVY INDUSTRIES ENGINE & TURBOCHARGER, LTD., Sagamihara (JP)

( * ) Notice: Subject to any disclaimer, the term of this patent is extended or adjusted under 35 U.S.C. 154(b) by 0 days.

(21) Appl. No.: 16/609,645

(22) PCT Filed: Nov. 6, 2017

(86) PCT No.: PCT/JP2017/039916
§ 371 (c)(1),
(2) Date: Oct. 30, 2019

(87) PCT Pub. No.: WO2019/087389
PCT Pub. Date: May 9, 2019

(65) Prior Publication Data

US 2020/0063749 A1 Feb. 27, 2020

(51) Int. Cl.
*F04D 29/28* (2006.01)
*F04D 29/66* (2006.01)
(Continued)

(52) U.S. Cl.
CPC ..... *F04D 29/284* (2013.01); *F04D 29/4213* (2013.01); *F04D 29/66* (2013.01); *F04D 29/685* (2013.01)

(58) Field of Classification Search
CPC .. F04D 29/284; F04D 29/162; F04D 29/4213; F04D 29/66; F04D 29/685;
(Continued)

(56) References Cited

U.S. PATENT DOCUMENTS 5,375,974 A * 12/1994 Heinrich ..... F04D 29/284 415/182.1
5,403,149 A 4/1995 Arnet et al.
(Continued)

FOREIGN PATENT DOCUMENTS

CN 101825113 A 9/2010
DE 2 165 610 A1 7/1973
(Continued)

OTHER PUBLICATIONS

Ibaraki et al., "Vortical Flow Structure and Loss Generation Process in a Transonic Centrifugal Compressor Impeller", Proceedings of ASME Turbo Expo 2007, GT2007-27791, May 14-17, 2007, Montreal, Canada, pp. 1-10.
(Continued)

*Primary Examiner* — Yi-Kai Wang
(74) *Attorney, Agent, or Firm* — Birch, Stewart, Kolasch & Birch, LLP

(57) ABSTRACT

A centrifugal compressor includes an impeller rotatably disposed and having a plurality of first blades and a shroud cover disposed on a leading edge side of the first blades partially in a rotational axis direction of the impeller and connecting the first blades circumferentially adjacent to each other. The shroud cover is shaped such that a position of at least one of an upstream edge or a downstream edge of the shroud cover in the rotational axis direction changes along a circumferential direction of the shroud cover.

8 Claims, 8 Drawing Sheets

(51) Int. Cl.
*F04D 29/42* (2006.01)
*F04D 29/68* (2006.01)

(58) Field of Classification Search
CPC ..... F05D 2220/40; F02C 6/12; F01D 17/00; F02B 37/00
USPC ..... 415/203
See application file for complete search history.

(56) References Cited

U.S. PATENT DOCUMENTS

| | | | | |
|---|---|---|---|---|
| 7,568,883 | B2 | 8/2009 | Arnold et al. | |
| 7,775,763 | B1 * | 8/2010 | Johnson | F04D 29/162 415/111 |
| 2010/0202887 | A1 * | 8/2010 | Bohl | F04D 29/681 416/183 |
| 2017/0260861 | A1 | 9/2017 | Yoshida et al. | |

FOREIGN PATENT DOCUMENTS

| | | | | |
|---|---|---|---|---|
| JP | S4873803 | | * | 12/1972 |
| JP | 6-193594 | A | | 7/1994 |
| JP | 6-235398 | A | | 8/1994 |
| JP | 2004-353607 | A | | 12/2004 |
| JP | 3653054 | B2 | | 5/2005 |
| JP | 2010-185456 | A | | 8/2010 |
| JP | 2011-94544 | A | | 5/2011 |
| JP | 2013-24057 | A | | 2/2013 |
| JP | 2016-35247 | A | | 3/2016 |
| JP | 2016035247 | A | * | 3/2016 |
| WO | WO 2016/051531 | A1 | | 4/2016 |

OTHER PUBLICATIONS

International Preliminary Report on Patentability and English translation of the Written Opinion of the International Searching Authority for International Application No. PCT/JP2017/039916, dated May 22, 2020.

International Search Report for International Application No. PCT/JP2017/039916, dated Jan. 23, 2018.

Office Action dated Jun. 18, 2020 issued in counterpart Chinese Application No. 201780091339.9 with a machine translation.

Japanese Office Action for Japanese Application No. 2019-550122, dated Dec. 1, 2020. with English translation.

Extended European Search Report for European Application No. 17930344.1, dated May 26, 2021.

* cited by examiner

CENTRIFUGAL COMPRESSOR AND TURBOCHARGER INCLUDING THE SAME

TECHNICAL FIELD

The present disclosure relates to a centrifugal compressor and a turbocharger including the centrifugal compressor.

BACKGROUND ART

Centrifugal compressors include a closed type in which the entire blades are covered with a shroud cover and an open type in which the blades are not covered with a shroud cover. Patent Documents 1 to 3 disclose a centrifugal compressor in which the blades are covered with a shroud cover partially in the rotational axis direction of the impeller, for instance, on the leading edge side of the blades.

CITATION LIST

Patent Literature

Patent Document 1: JPH6-235398A
Patent Document 2: JPH6-193594A
Patent Document 3: JP3653054B

SUMMARY

Problems to be Solved

The shroud cover provided to the centrifugal compressor in Patent Documents 1 to 3 is cylindrical with a constant shape along the circumferential direction of the shroud cover. Covering the blades with such a shroud cover has an advantage of reducing the occurrence of clearance flow, but also has some disadvantages. The conventional cylindrical shroud cover cannot overcome these disadvantages.

In view of the above, an object of at least one embodiment of the present disclosure is to provide a centrifugal compressor which includes blades covered with a shroud cover partially in the rotational axis direction of an impeller but can reduce disadvantages caused by the provision of the shroud cover, and a turbocharger including the centrifugal compressor.

Solution to the Problems (1) A centrifugal compressor according to at least one embodiment of the present disclosure comprises: an impeller rotatably disposed and having a plurality of first blades; and a shroud cover disposed on a leading edge side of the first blades partially in a rotational axis direction of the impeller and connecting the first blades circumferentially adjacent to each other. The shroud cover is shaped such that a position of at least one of an upstream edge or a downstream edge of the shroud cover in the rotational axis direction changes along a circumferential direction of the shroud cover.

With the above configuration (1), since the shroud cover has a shape that can deal with disadvantages caused by the provision of the shroud cover, it is possible to reduce the disadvantages.

(2) In some embodiments, in the above configuration (1), a portion of the shroud cover connected to a pressure side of each first blade and a portion of the shroud cover connected to a suction side of each first blade are each in a range of 30% or less of a meridional length of each first blade from the leading edge toward a trailing edge of the first blade.

The present inventors have performed CFD analysis and consequently found that the clearance flow mainly occurs in a range of 30% or less of the meridional length of the first blade. With the above configuration (2), by the shroud cover disposed in the range of 30% or less of the meridional length of the first blade from the leading edge toward the trailing edge of the first blade, it is possible to reduce the occurrence of clearance flow.

(3) In some embodiments, in the above configuration (1) or (2), one of a portion of the shroud cover connected to a pressure side of each first blade or a portion of the shroud cover connected to a suction side of each first blade is longer than the other.

A first natural mode of vibration of the first blade consists of vibration of a leading edge portion of the first blade. Accordingly, when the shroud cover is disposed on the leading edge side of the first blade, the mass is applied to the vibrating portion, which leads to a reduction in eigenvalue. However, with the above configuration (3), since the shroud cover has a portion with a narrow width in the rotational axis direction, it is possible to reduce the mass of the shroud cover, and as a result, it is possible to reduce vibration of the blade, compared with the case where the width of the shroud cover in the rotational axis direction is constant along the circumferential direction.

Further, the clearance flow at the leading edge of the first blade occurs from the pressure side to the suction side of the first blade. Accordingly, in order to reduce the occurrence of loss due to clearance flow, the shroud cover has only to cover a necessary range of the first blade on either the pressure side or the suction side of the first blade. With the above configuration (3), the occurrence of loss due to clearance flow is suppressed by the portion connected to the pressure side or the suction side of the first blade.

(4) In some embodiments, in any one of the above configurations (1) to (3), a portion of the upstream edge of the shroud cover between a portion connected to a pressure side of one of two circumferentially adjacent first blades of the plurality of first blades and a portion connected to a suction side of the other of the two circumferentially adjacent first blades is positioned further toward a trailing edge side of the first blades than a throat position.

When the blade is covered with the shroud cover, the throat area may be reduced, so that the flow rate may be reduced. With the above configuration (4), since the shroud cover is disposed away from the throat position, it is possible to suppress the reduction in flow rate.

(5) In some embodiments, in the above configuration (4), a leading end of the portion of the shroud cover connected to the pressure side of the first blade is positioned at the leading edge of the first blade, and a leading end of the portion of the shroud cover connected to the suction side of the first blade is positioned further toward the trailing edge side of the first blades than the throat position.

With the above configuration (5), since the shroud cover is disposed away from the throat position, it is possible to suppress the reduction in flow rate.

(6) In some embodiments, in any one of the above configurations (1) to (5), the impeller further includes a plurality of second blades each of which is disposed between two circumferentially adjacent first blades of the plurality of first blades, each second blade having a leading edge positioned further toward a trailing edge side than the leading edge of each first blade, each second blade having a meridional length shorter than each first blade. The shroud cover connects the circumferentially adjacent first blades and the second blades disposed between the first blades.

With the above configuration (6), since the shroud cover connects the first blade with the second blade having a different vibration mode from the first blade, it is possible to reduce vibration in the natural mode of the first blade.

(1) A centrifugal compressor according to at least one embodiment of the present disclosure comprises: an impeller rotatably disposed and having a plurality of first blades and a plurality of second blades each of which is disposed between two circumferentially adjacent first blades of the plurality of first blades; and a shroud cover disposed on a leading edge side of the first blades partially in a rotational axis direction of the impeller. Each second blade has a leading edge positioned further toward a trailing edge side than a leading edge of each first blade and has a meridional length shorter than each first blade. The shroud cover connects the circumferentially adjacent first blades and the second blades disposed between the first blades.

With the above configuration (7), since the shroud cover connects the first blade with the second blade having a different vibration mode from the first blade, it is possible to reduce vibration in the natural mode of the first blade.

(8) A turbocharger according to at least one embodiment of the present disclosure comprises: the centrifugal compressor described in any one of the above (1) to (7).

With the above configuration (8), since the shroud cover has a shape that can deal with disadvantages caused by the provision of the shroud cover, it is possible to reduce the disadvantages.

Advantageous Effects

According to at least one embodiment of the present disclosure, since the shroud cover is shaped such that the position of at least one of the upstream edge or the downstream edge of the shroud cover in the rotational axis direction changes along the circumferential direction of the shroud cover, the shroud cover has a shape that can deal with disadvantages caused by the provision of the shroud cover. Thus, it is possible to reduce the disadvantages.

DETAILED DESCRIPTION

Embodiments of the present invention will now be described in detail with reference to the accompanying drawings. However, the scope of the present invention is not limited to the following embodiments. It is intended that dimensions, materials, shapes, relative positions and the like of components described in the embodiments shall be interpreted as illustrative only and not intended to limit the scope of the present invention.

A centrifugal compressor according to the following embodiments of the present disclosure will be described by taking a centrifugal compressor of a turbocharger as an example. However, the centrifugal compressor in the present disclosure is not limited to a centrifugal compressor of a turbocharger, and may be any centrifugal compressor which operates alone. Although a fluid to be compressed by the compressor is air in the following description, the fluid may be replaced by any other fluid.

First Embodiment

Figure 1:
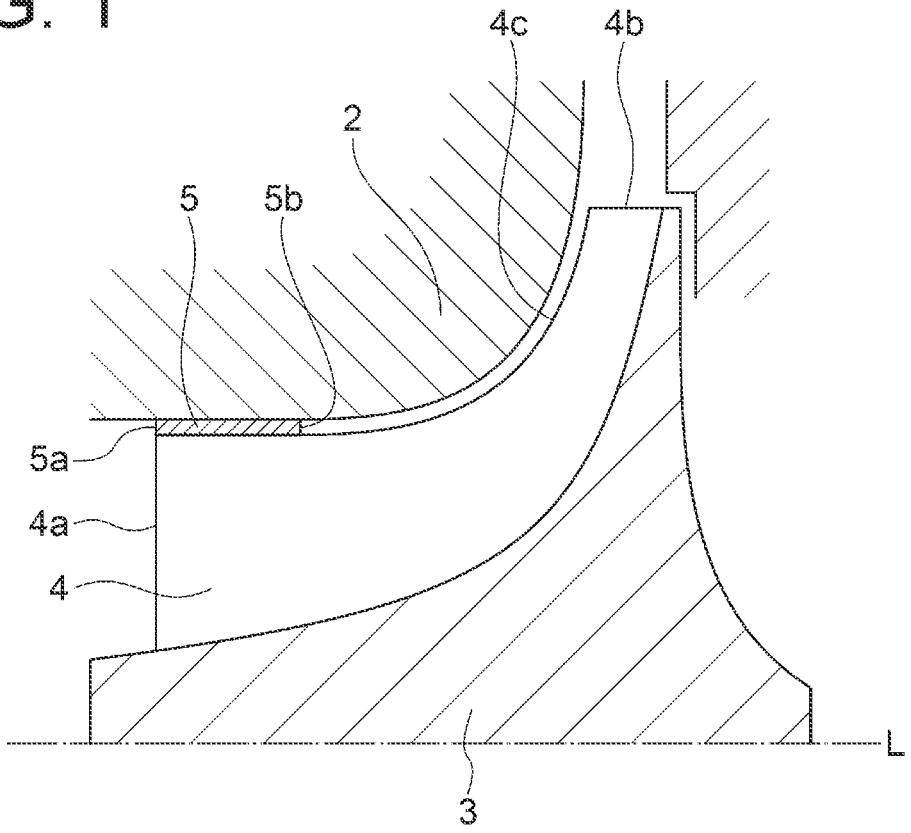
FIG. 1 is a partial cross-sectional view of a centrifugal compressor according to a first embodiment of the present disclosure.

As shown in FIG. 1, a centrifugal compressor 1 according to the first embodiment includes a housing 2 and an impeller 3 rotatably disposed around the rotational axis L within the housing 2. The impeller 3 has a plurality of first blades 4 (only one first blade 4 is depicted in FIG. 1) of streamlined shape disposed at a predetermined interval in the circumferential direction.

The impeller 3 is provided with an annular shroud cover 5 partially in the rotational axis L direction from a leading edge 4*a* toward a trailing edge 4*b* of the first blade 4. The shroud cover 5 connects outer peripheral edges 4*c*, 4*c* of circumferentially adjacent first blades 4, 4. A range in which the shroud cover 5 is disposed will now be described.

Figure 2:
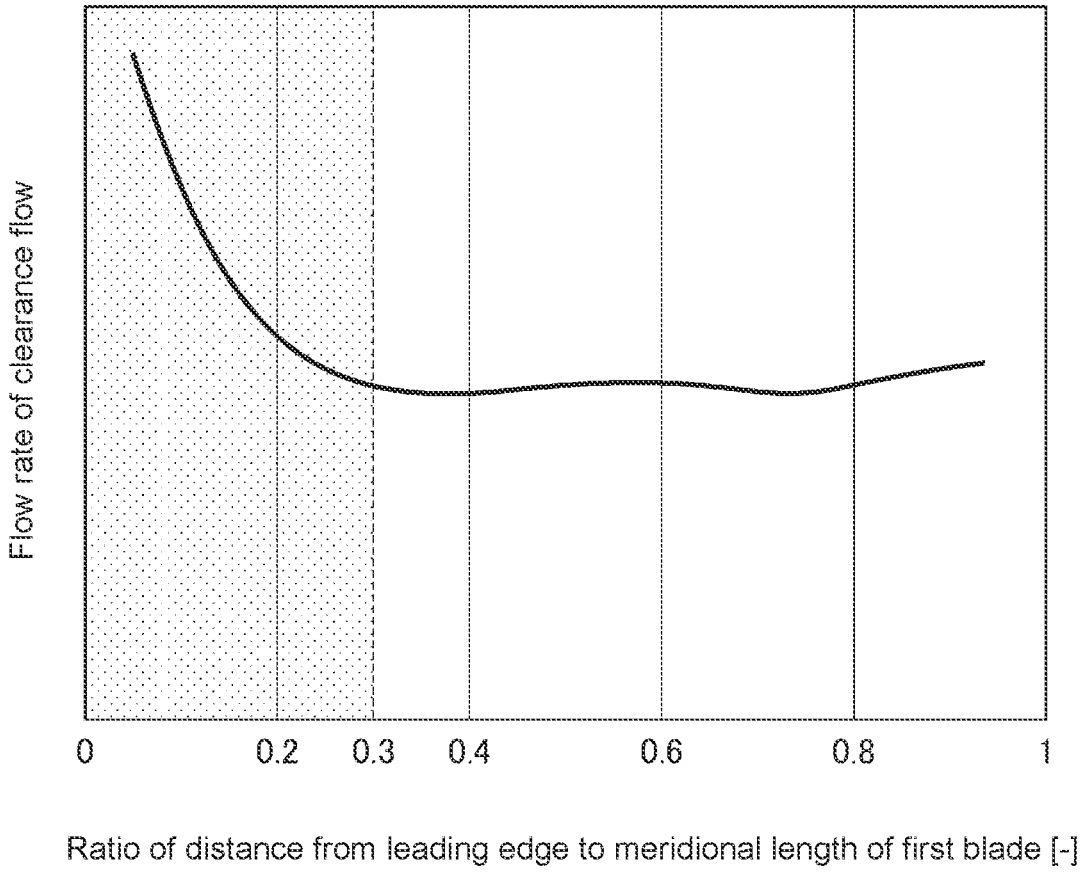
FIG. 2 is a graph showing the distribution of clearance flow obtained by CFD analysis by the present inventors.

The present inventors applied CFD analysis to a centrifugal compressor including an open type impeller with blades not covered with a shroud cover to measure a region in which the clearance flow occurs. The analysis results are shown in FIG. 2. From these results, it is revealed that the clearance flow mainly occurs in a range of 30% or less of the meridional length starting from the leading edge 4*a* toward the trailing edge 4*b* of the first blade 4. Therefore, in order to reduce the occurrence of clearance flow, the shroud cover 5 is preferably disposed in this range. Even if the shroud cover 5 is disposed away from the above range toward the trailing edge 4*b*, the effect of reducing the occurrence of clearance flow is not improved.

Further, the present inventors have reported results of CFD analysis on a centrifugal compressor of closed type (see Ibaraki, S., Furukawa, M., Iwakiri, K., and Takahashi, K., Vortical flow structure and loss generation process in a transonic centrifugal compressor impeller, Proceedings of ASME Turbo Expo 2007, Montreal, Canada, GT2007-27791 (2007)). According to this report, the closed type centrifugal compressor has an advantage in that the occurrence of loss due to clearance flow is reduced, but also has a disadvantage in that loss is caused due to roll-up vortex of low energy fluid accumulated on the trailing edge of the blade.

According to the results of CFD analysis by the present inventors, as shown in FIG. 1, in the centrifugal compressor 1, since the shroud cover 5 is disposed in a range of 30% or less of the meridional length of the first blade 4 from the leading edge 4*a* toward the trailing edge 4*b* of the first blade 4, it is possible to reduce the occurrence of clearance flow, and simultaneously, since the shroud cover is not disposed in the vicinity of the trailing edge 4*b* of the first blade 4, it is possible to suppress the occurrence of loss due to roll-up vortex.

However, the centrifugal compressor 1 with the shroud cover 5 disposed partially in the rotational axis L direction of the impeller 3 has a significant disadvantage in that the eigenvalue is reduced. A first natural mode of the first blade 4 consists of vibration at the leading edge 4*a*. In the centrifugal compressor 1, since the mass of the shroud cover 5 is applied to this portion, the eigenvalue is reduced. To suppress the reduction in eigenvalue, it is necessary to improve the shape of the shroud cover 5.

In view of this, the shroud cover 5 provided to the centrifugal compressor 1 is shaped such that the position of the downstream edge 5*b* in the rotational axis L direction changes along the circumferential direction of the shroud cover 5. More specifically, as shown in FIG. 3, the shroud cover 5 is shaped such that a trailing end 11*b* of a portion 11 connected to a pressure side 4*d* of the first blade 4 is positioned further toward the leading edge 4*a* side of the first blade 4 than a trailing end 12*b* of a portion 12 connected to a suction side 4*e* of the first blade 4, i.e., the meridional length of the portion 11 connected to the pressure side 4*d* of the first blade 4 is shorter than the meridional length of the portion 12 connected to the suction side 4*e* of the first blade 4.

Figure 4:
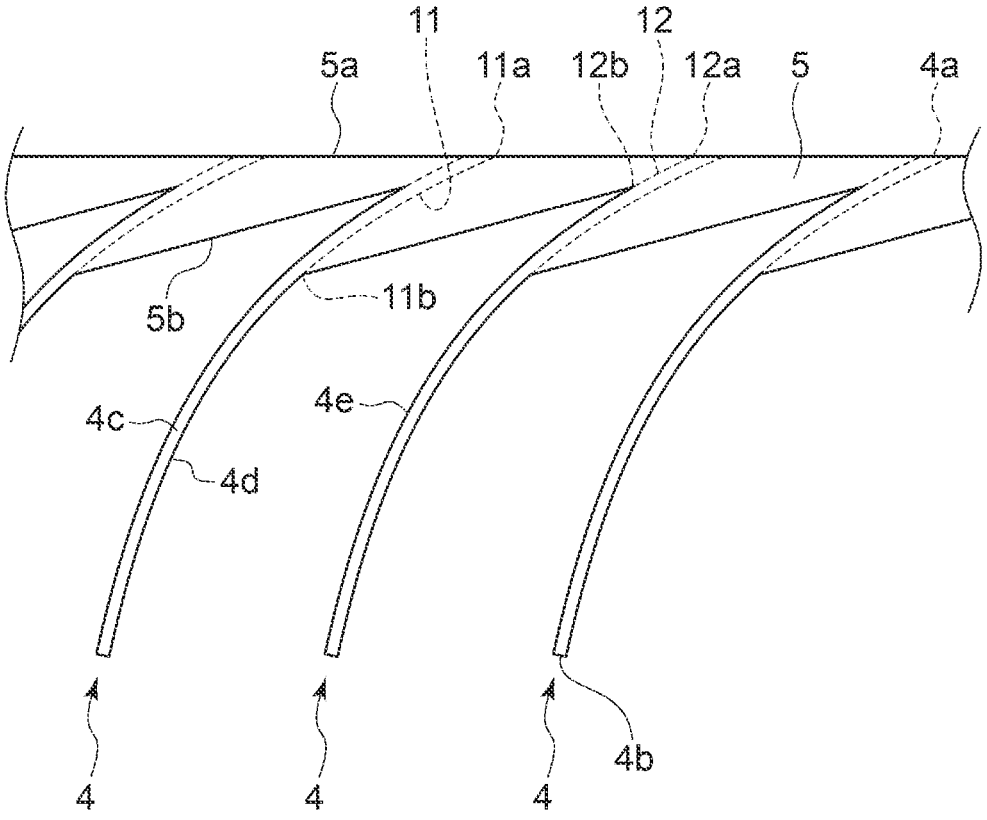
FIG. 4 is a diagram showing another example of the shroud cover provided to the centrifugal compressor according to the first embodiment of the present disclosure.

Alternatively, as shown in FIG. 4, the shroud cover 5 may be shaped such that the trailing end 12*b* of the portion 12 connected to the suction side 4*e* of the first blade 4 is positioned further toward the leading edge 4*a* side of the first blade 4 than the trailing end 11*b* of the portion 11 connected to the pressure side 4*d* of the first blade 4, i.e., the meridional length of the portion 12 connected to the suction side 4*e* of the first blade 4 is shorter than the meridional length of the portion 11 connected to the pressure side 4*d* of the first blade 4.

Figure 3:
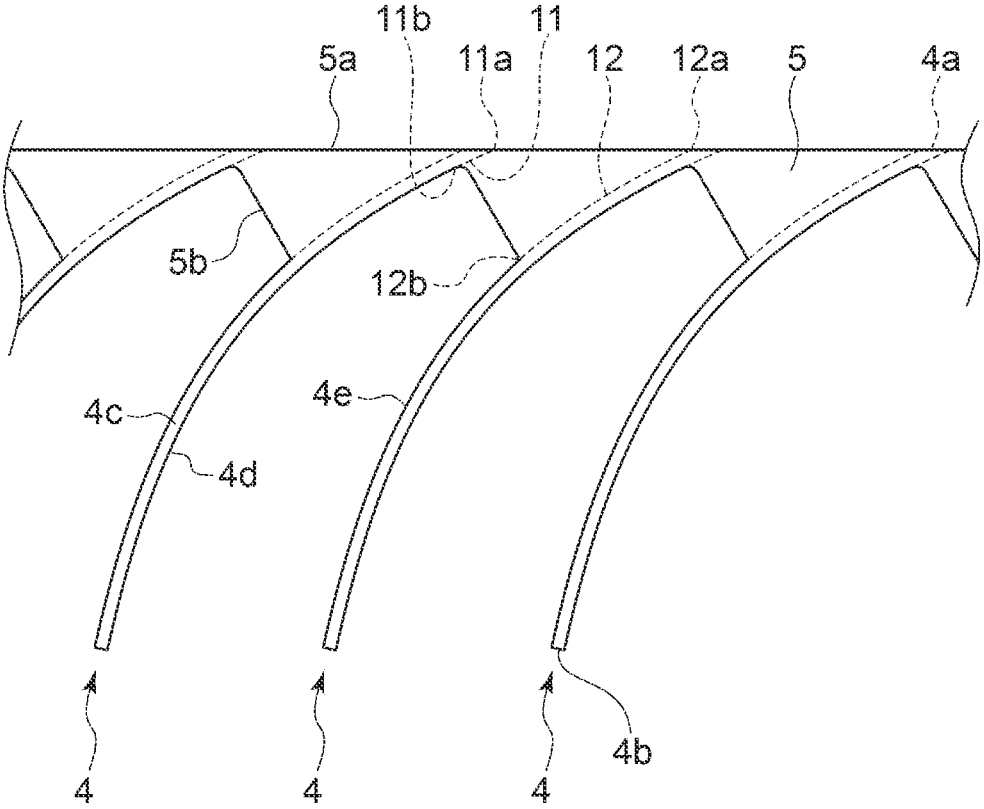
FIG. 3 is a diagram showing an example of a shroud cover provided to the centrifugal compressor according to the first embodiment of the present disclosure.

In the shroud cover 5 shown in FIGS. 3 and 4, respectively, a portion with a narrow width in the rotational axis L direction (see FIG. 1) exists in the trailing end 11*b* and the trailing end 12*b*. Thus, it is possible to reduce the mass of the shroud cover 5 compared with the case where the position of the downstream edge 5*b* of the shroud cover 5 in the rotational axis L direction is constant along the circumferential direction of the shroud cover 5, i.e., compared with the case where the width in the rotational axis L direction is constant along the circumferential direction. As a result, it is possible to reduce vibration of the first blade 4.

On the other hand, the clearance flow at the leading edge 4*a* of the first blade 4 occurs from the pressure side 4*d* to the suction side 4*e*. Therefore, in order to reduce the occurrence of clearance flow, either the portion 11 connected to the pressure side 4*d* or the portion 12 connected to the suction side 4*e* has only to sufficiently cover 30% or less of the meridional length of the first blade 4 from the leading edge 4*a* toward the trailing edge 4*b*. Since the shroud cover 5 shown in FIGS. 3 and 4 covers the whole of this range of the portion 12 and the portion 11, it is possible to reduce the occurrence of clearance flow, while reducing vibration of the first blade 4 by reducing the mass of the shroud cover 5.

Thus, since the shroud cover 5 shaped such that the position of the downstream edge 5*b* in the rotational axis L direction changes along the circumferential direction of the shroud cover 5 has a portion with a narrow width in the rotational axis L direction, it is possible to reduce the mass of the shroud cover 5, and as a result, it is possible to reduce vibration of the first blade 4, compared with the case where the positions of the upstream edge 5*a* and the downstream edge 5*b* of the shroud cover 5 in the rotational axis L direction are constant along the circumferential direction of the shroud cover 5.

Although in the first embodiment, the shroud cover 5 has a shape such that one of the meridional length of the portion 11 connected to the pressure side 4*d* of the first blade 4 or the meridional length of the portion 12 connected to the suction side 4*e* of the first blade 4 is shorter than the other, it is not limited to this embodiment. The shroud cover 5 may include both a portion where the meridional length of the portion 11 connected to the pressure side 4*d* of the first blade 4 is shorter than the meridional length of the portion 12 connected to the suction side 4*e* of the first blade 4, and a portion where the meridional length of the portion 12 connected to the suction side 4*e* of the first blade 4 is shorter than the meridional length of the portion 11 connected to the pressure side 4*d* of the first blade 4.

Although in the first embodiment, the entire shroud cover 5 is disposed in the range of 30% or less of the meridional length of the first blade 4 from the leading edge 4*a* toward the trailing edge 4*b* of the first blade 4, it is not limited to this embodiment. As long as at least the portion 11 connected to the pressure side 4*d* of the first blade 4 and the portion 12 connected to the suction side 4*e* of the first blade 4 are in this range, the downstream edge 5*b* between the portions 11 and 12 may be out of this range.

Second Embodiment

Next, a centrifugal compressor according to the second embodiment will be described. The centrifugal compressor according to the second embodiment is a modification of the first embodiment in which the shape of the shroud cover 5 is changed. In the second embodiment, the same constituent elements as those in the first embodiment are associated with the same reference numerals and not described again in detail.

Figure 5:
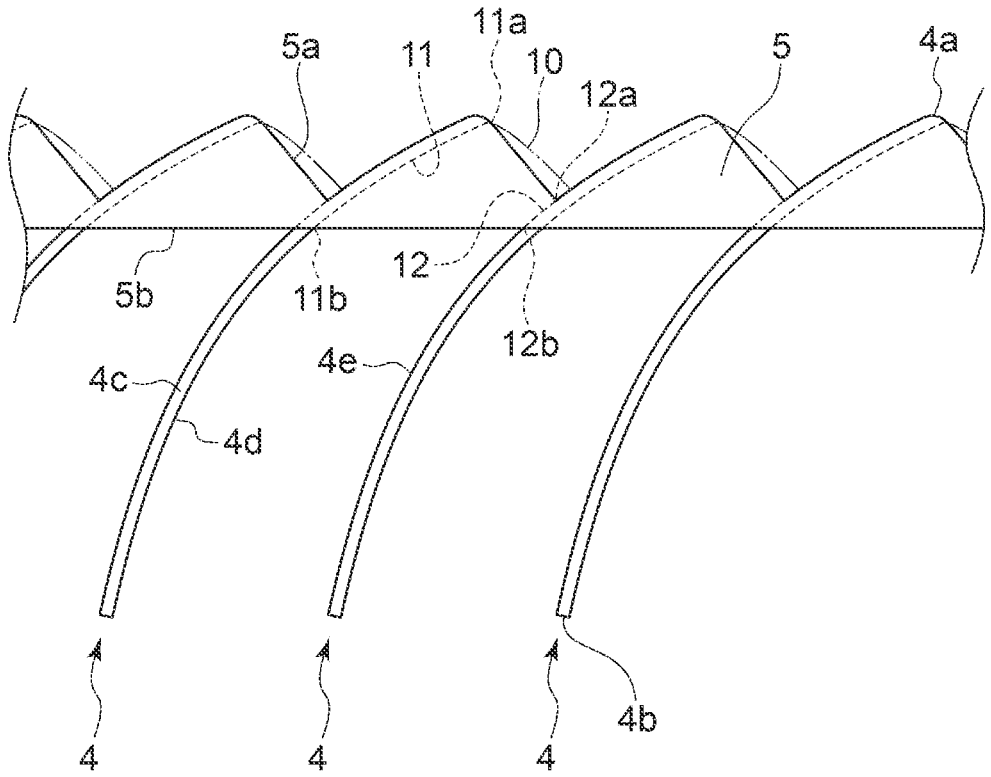
FIG. 5 is a diagram showing a shroud cover disposed on a centrifugal compressor according to a second embodiment of the present disclosure.

In the second embodiment, the shroud cover 5 is shaped such that the position of the upstream edge 5*a* in the rotational axis L direction changes along the circumferential direction of the shroud cover 5. More specifically, as shown in FIG. 5, the shroud cover 5 is shaped such that a leading end 12*a* of the portion 12 connected to the suction side 4*e* of the first blade 4 is positioned further toward the trailing edge 4*b* side of the first blade 4 than a leading end 11*a* of the portion 11 connected to the pressure side 4*d* of the first blade 4 in the rotational axis L direction, and the leading end 12*a* is positioned further toward the trailing edge 4*b* side of the first blade 4 than a throat position 10 in the rotational axis L direction. The configuration is otherwise the same as that of the first embodiment.

When the first blade 4 is covered with the shroud cover 5, although the occurrence of clearance flow is reduced as described above in the first embodiment, a disadvantage arises in that the flow rate may be reduced due to a decrease in throat area by the thickness of the shroud cover 5. However, in the configuration of the second embodiment, since the shroud cover 5 is disposed away from the throat position 10, it is possible to suppress the reduction in flow rate.

Further, since the shroud cover 5 in the second embodiment is shaped such that the position of the upstream edge 5*a* in the rotational axis L direction changes along the circumferential direction of the shroud cover 5 and thus has a portion with a narrow width in the rotational axis L direction, it is possible to reduce vibration of the first blade 4 as in the first embodiment. Further, in the shroud cover 5 in the second embodiment, since the portion 11 connected to the pressure side 4*d* of the first blade 4 covers the entire range of 30% or less of the meridional length of the first blade 4 from the leading edge 4*a* toward the trailing edge 4*b* of the first blade 4, it is possible to reduce the occurrence of clearance flow as in the first embodiment.

Although in the second embodiment, the entire upstream edge 5*a* of the shroud cover 5 between the leading end 11*a* and the leading end 12*a* is positioned further toward the trailing edge 4*b* side of the first blade 4 than the throat position 10 in the rotational axis L direction, it is not limited to this embodiment. A portion of the upstream edge 5*a* of the shroud cover 5 between the leading end 11*a* and the leading end 12*a* may be positioned further toward the trailing edge 4*b* side of the first blade 4 than the throat position 10 in the rotational axis L direction.

Although in the second embodiment, the position of the downstream edge 5*b* of the shroud cover 5 in the rotational axis L direction is constant, it is not limited to this embodiment. The position of the downstream edge 5*b* of the shroud cover 5 in the rotational axis L direction may also change along the circumferential direction. That is, the configuration of the shroud cover 5 in the first embodiment may be combined with the configuration of the shroud cover 5 in the second embodiment.

Third Embodiment

Next, a centrifugal compressor according to the third embodiment will be described. The centrifugal compressor according to the third embodiment is a modification of the first and second embodiments in that the impeller 3 includes, beside the first blade 4, a second blade having a different shape from the first blade 4. In the following, the third embodiment will be described using an embodiment in which the centrifugal compressor in the first embodiment is modified. However, the centrifugal compressor in the second embodiment can also be modified into the third embodiment. Further, in the third embodiment, the same constituent elements as those in the first embodiment are associated with the same reference numerals and not described again in detail.

Figure 6:
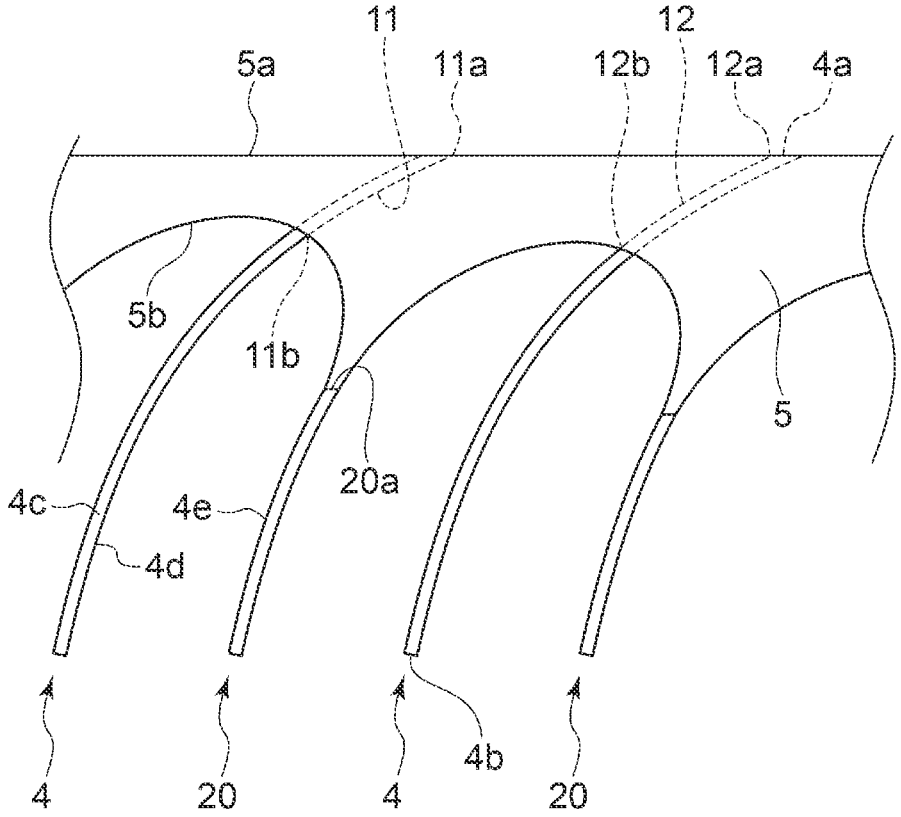
FIG. 6 is a diagram showing a shroud cover disposed on a centrifugal compressor according to the third embodiment of the present disclosure.

As shown in FIG. 6, the impeller 3 has a plurality of first blades 4 of streamlined shape disposed at a predetermined interval in the circumferential direction, and a plurality of splitter blades 20, i.e., second blades, each of which is disposed between circumferentially adjacent first blades 4, 4. The splitter blade 20 has a leading edge 20*a* positioned further toward the trailing edge 4*b* side than the leading edge 4*a* of the first blade 4, and has a meridional length shorter than the first blade 4.

The shroud cover 5 connects the circumferentially adjacent first blades 4, 4 and the splitter blade 20 between the first blades 4, 4 to each other. The shroud cover 5 is shaped such that the position of the downstream edge 5*b* in the rotational axis L direction changes along the circumferential direction. The configuration is otherwise the same as that of the first embodiment.

In the configuration of the third embodiment, since the shroud cover 5 connects the first blade 4 with the splitter blade 20 having a different vibration mode from the first blade 4, it is possible to reduce vibration in the natural mode of the first blade 4.

Further, in the shroud cover 5 in the third embodiment, since the portion 11 connected to the pressure side 4*d* of the first blade 4 covers the range of 30% or less of the meridional length from the leading edge 4*a* toward the trailing edge 4*b* of the first blade 4, it is possible to reduce the occurrence of clearance flow as in the first embodiment.

Figure 7:
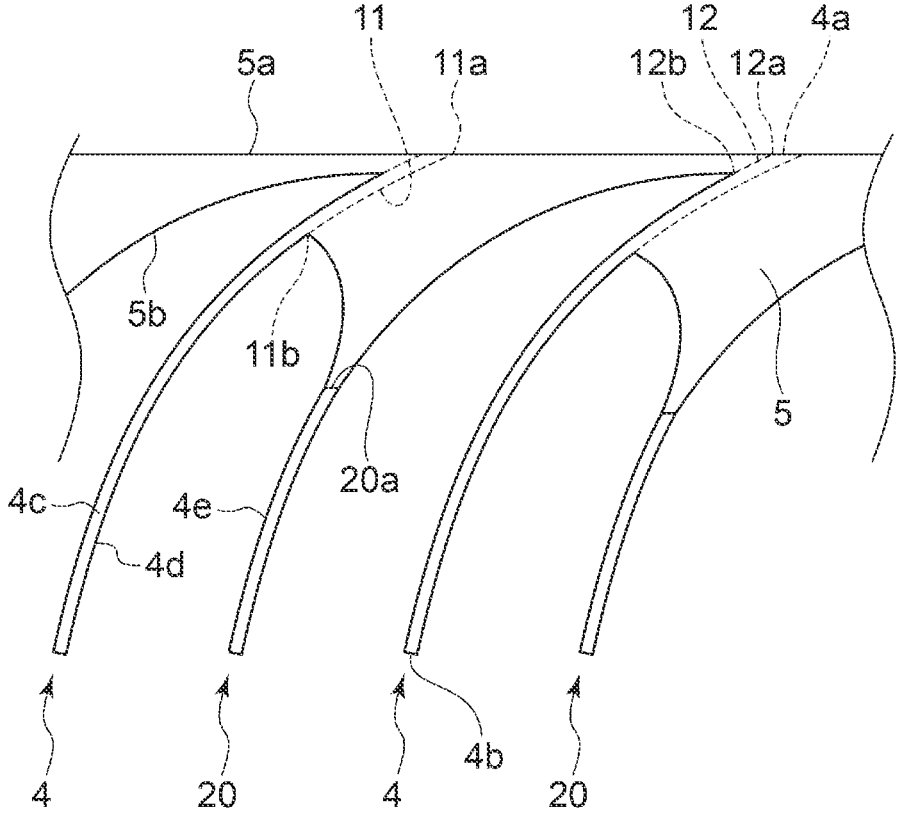
FIG. 7 is a diagram showing a modification of the shroud cover provided to the centrifugal compressor according to the third embodiment of the present disclosure.

As shown in FIG. 7, the shroud cover 5 in the third embodiment may be shaped such that the trailing end 12*b* of the portion 12 connected to the suction side 4*e* of the first blade 4 is positioned further toward the leading edge 4*a* side of the first blade 4 than the trailing end 11*b* of the portion 11 connected to the pressure side 4*d* of the first blade 4. In this case, since the mass of the shroud cover 5 is reduced compared with the shroud cover 5 of FIG. 6, it is possible to reduce vibration of the first blade 4. Further, since the portion 11 covers the entire range of 30% or less of the meridional length from the leading edge 4*a* toward the trailing edge 4*b* of the first blade 4, it is possible to reduce the occurrence of clearance flow as in the shroud cover 5 of FIG. 6.

Figure 8:
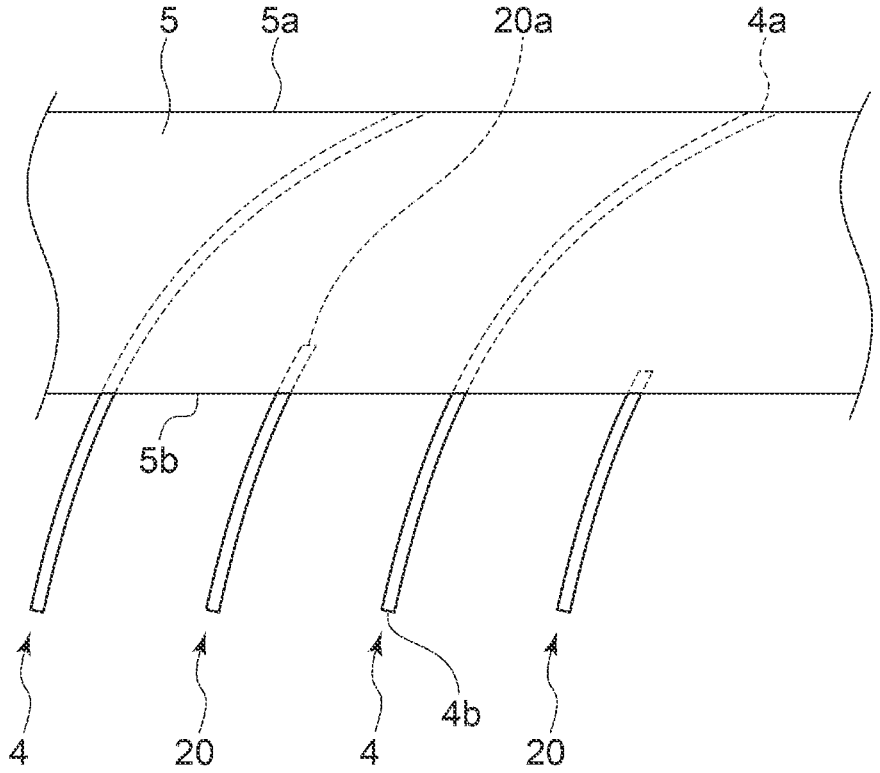
FIG. 8 is a diagram showing another modification of the shroud cover provided to the centrifugal compressor according to the third embodiment of the present disclosure.

As shown in FIG. 8, the shroud cover 5 in the third embodiment may be configured such that the positions of the upstream edge 5*a* and the downstream edge 5*b* in the rotational axis L direction (see FIG. 1) is constant along the circumferential direction of the shroud cover 5, and the circumferentially adjacent first blades 4, 4, and the splitter blade 20 between the first blades 4, 4 are connected to each other. In this case, similarly, since the shroud cover 5 connects the first blade 4 with the splitter blade 20 having a different vibration mode from the first blade 4, it is possible to reduce vibration in the natural mode of the first blade 4.

REFERENCE SIGNS LIST

1 Centrifugal compressor
2 Housing
3 Impeller
4 First blade
4*a* Leading edge (of first blade)
4*b* Trailing edge (of first blade)
4*c* Outer peripheral edge (of first blade)
4*d* Pressure side (of first blade)
4*e* Suction side (of first blade)
5 Shroud cover
5*a* Upstream edge (of shroud cover)
5*b* Downstream edge (of shroud cover)
10 Throat position
11 Portion connected to pressure side of first blade
11*a* Leading end (of portion connected to pressure side of first blade)
11*b* Trailing end (of portion connected to pressure side of first blade)
12 Portion connected to suction side of first blade
12*a* Leading end (of portion connected to suction side of first blade)
12*b* Trailing end (of portion connected to suction side of first blade)
20 Splitter blade (Second blade)

The invention claimed is:

1. A centrifugal compressor comprising:

an impeller rotatably disposed and having a plurality of first blades; and a shroud cover disposed on a leading edge side of the first blades partially in a rotational axis direction of the impeller and connecting the first blades circumferentially adjacent to each other, wherein the shroud cover is shaped such that a position of at least one of an upstream edge or a downstream edge of the shroud cover in the rotational axis direction changes along a circumferential direction of the shroud cover, and a position of the upstream edge in the rotational axis direction is the same as a position of a leading edge of each first blade in the rotational axis direction or further toward a trailing edge side of the first blades than the leading edge in the rotational axis direction, and wherein one of the upstream edge or the downstream edge of the shroud cover, of which position in the rotational axis direction changes along a circumferential direction of the shroud cover, intersects a pressure side and a suction side of each first blade at different positions in the rotational axis direction.

2. The centrifugal compressor according to claim 1, wherein a portion of the shroud cover connected to a pressure side of each first blade and a portion of the shroud cover connected to a suction side of each first blade are each in a range of 30% or less of a meridional length of each first blade from the leading edge toward a trailing edge of the first blade.

3. The centrifugal compressor according to claim 1, wherein one of a portion of the shroud cover connected to a pressure side of each first blade or a portion of the shroud cover connected to a suction side of each first blade is longer than the other.

4. A centrifugal compressor comprising:

an impeller rotatably disposed and having a plurality of first blades; and a shroud cover disposed on a leading edge side of the first blades partially in a rotational axis direction of the impeller and connecting the first blades circumferentially adjacent to each other, wherein the shroud cover is shaped such that a position of at least one of an upstream edge or a downstream edge of the shroud cover in the rotational axis direction changes along a circumferential direction of the shroud cover, and a position of the upstream edge in the rotational axis direction is the same as a position of a leading edge of each first blade in the rotational axis direction or further toward a trailing edge side of the first blades than the leading edge in the rotational axis direction, wherein a portion of the upstream edge of the shroud cover between a portion connected to a pressure side of one of two circumferentially adjacent first blades of the plurality of first blades and a portion connected to a suction side of the other of the two circumferentially adjacent first blades is positioned further toward the trailing edge side of the first blades than a throat position.

5. The centrifugal compressor according to claim 4, wherein a leading end of the portion of the shroud cover connected to the pressure side of the first blade is positioned at the leading edge of the first blade, and a leading end of the portion of the shroud cover connected to the suction side of the first blade is positioned further toward the trailing edge side of the first blades than the throat position.

6. The centrifugal compressor according to claim 1, wherein the impeller further includes a plurality of second blades each of which is disposed between two circumferentially adjacent first blades of the plurality of first blades, each second blade having a leading edge positioned further toward the trailing edge side than the leading edge of each first blade, each second blade having a meridional length shorter than each first blade, and wherein the shroud cover connects the circumferentially adjacent first blades and the second blades disposed between the first blades.

7. A turbocharger comprising the centrifugal compressor according to claim 1.

8. A turbocharger comprising the centrifugal compressor according to claim 4.

* * * * *